United States Patent [19]

Crosnier et al.

[11] Patent Number: 4,772,906

[45] Date of Patent: Sep. 20, 1988

[54] PHOTOCOPY DEVELOPMENT STATION

[75] Inventors: Daniel Crosnier, Offranville; Jean-Claude Leroux, Arques La Bataille, both of France

[73] Assignee: REGMA, Nanterre Cedex, France

[21] Appl. No.: 907,831

[22] Filed: Sep. 16, 1986

[30] Foreign Application Priority Data

Sep. 16, 1985 [FR] France ..... 85 13857
May 22, 1986 [FR] France ..... 86 07505

[51] Int. Cl.[4] ..... G03D 7/00
[52] U.S. Cl. ..... 354/300; 355/106
[58] Field of Search ..... 354/299, 300; 355/106

[56] References Cited

U.S. PATENT DOCUMENTS

| | | | |
|---|---|---|---|
| 3,122,981 | 3/1964 | Ellis et al. | 354/300 |
| 3,268,694 | 8/1966 | Liebermann et al. . | |
| 3,710,708 | 1/1973 | Schuman et al. | 354/300 |
| 3,915,708 | 10/1975 | Zausmer et al. | 354/300 |
| 4,241,989 | 12/1980 | Jackson et al. | 354/300 |
| 4,273,435 | 6/1981 | Hewelt et al. | 354/300 |
| 4,288,155 | 9/1981 | Patrick | 354/300 |
| 4,371,247 | 2/1983 | Hewelt et al. | 354/300 |
| 4,441,803 | 4/1984 | Pelis | 354/300 |
| 4,582,423 | 4/1986 | Putnam et al. | 355/106 |

FOREIGN PATENT DOCUMENTS

| | | |
|---|---|---|
| 1135759 | 8/1962 | Fed. Rep. of Germany . |
| 3232598 | 3/1984 | Fed. Rep. of Germany . |
| 1421713 | 12/1965 | France . |
| 2358686 | 2/1978 | France . |
| 8002465 | 11/1983 | PCT Int'l Appl. . |
| 821031 | 9/1959 | United Kingdom . |
| 1533837 | 11/1978 | United Kingdom . |

*Primary Examiner*—A. A. Mathews
*Attorney, Agent, or Firm*—Burns, Doane, Swecker & Mathis

[57] ABSTRACT

An essentially odorless photocopy development station, adopted for use in diazotype reprography apparatus, includes means for driving a copy bearing a latent image and means for developing said latent image, said copy drive means comprising a rotary cylinder engaging a tensioned fixed web and said web encircling a portion of the circumferential face surface of said cylinder, whereby a copy can be frictionally rotated therebetween, and said developing means comprising at least one pathway on the outside face surface of said web, with the interior of said pathway being in communicating relationship with the inside face surface of said web, e.g., via a plurality of apertures extending therethrough, and adopted to deliver developer material to a copy being frictionally rotated between said cylinder and said web.

22 Claims, 6 Drawing Sheets

FIG. 2
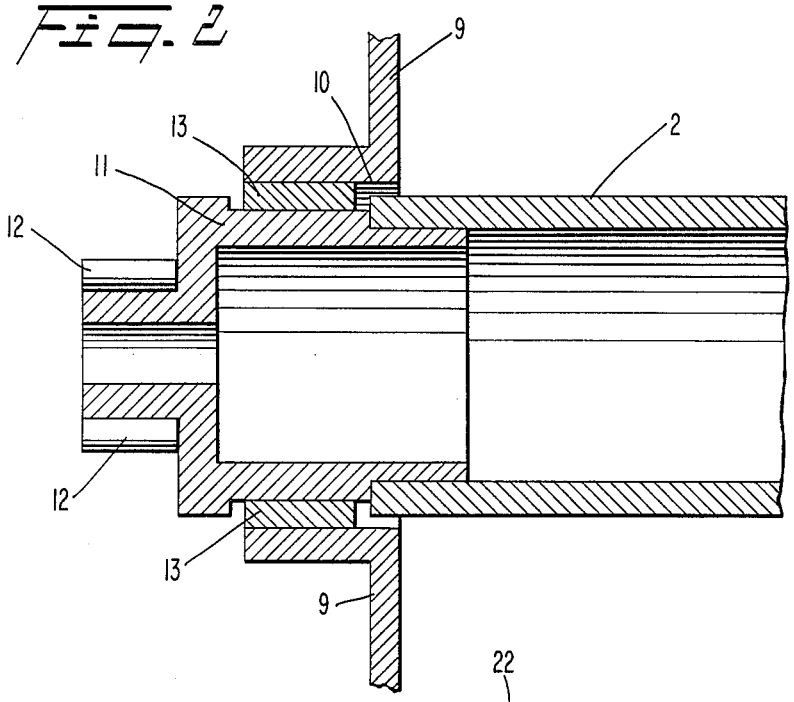
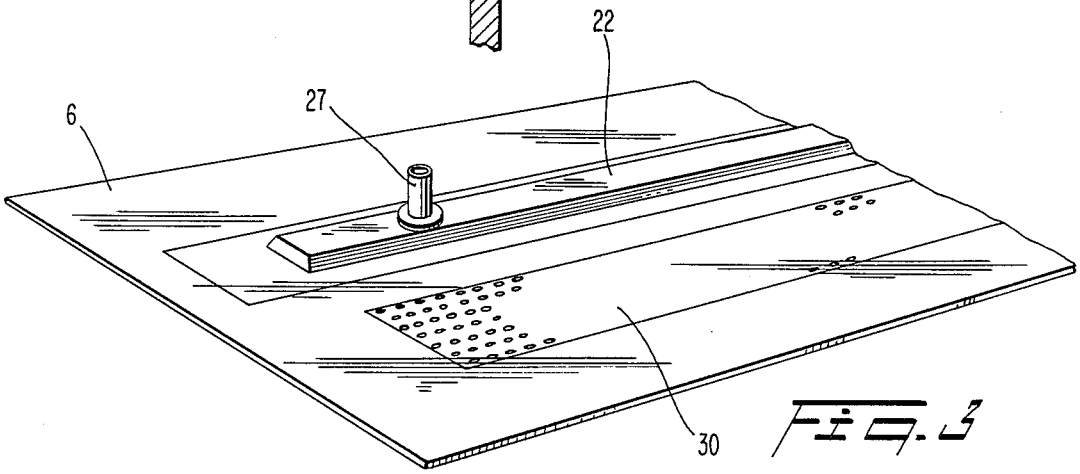
FIG. 3
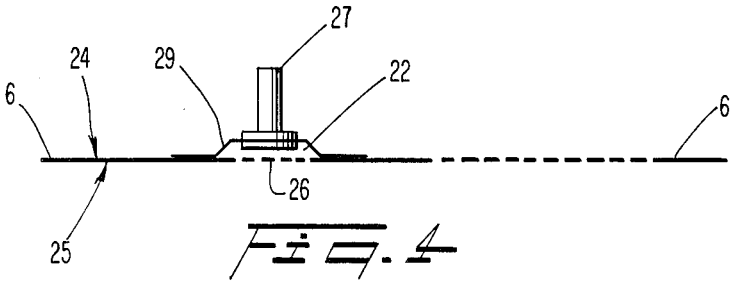
FIG. 4

Fig. 6
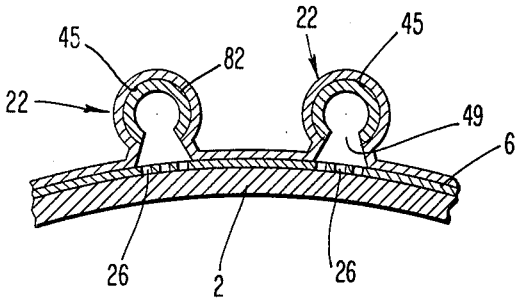
Fig. 8
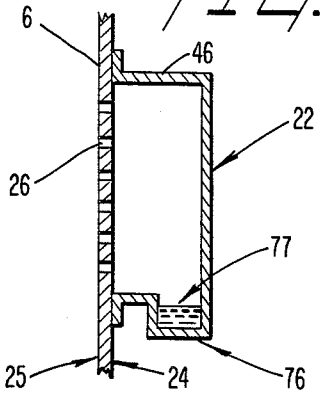
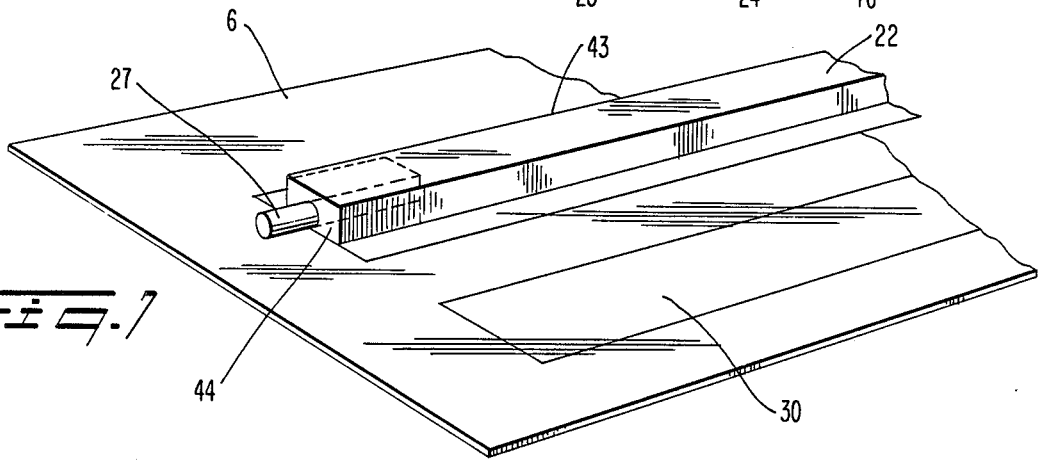
Fig. 7
Fig. 9
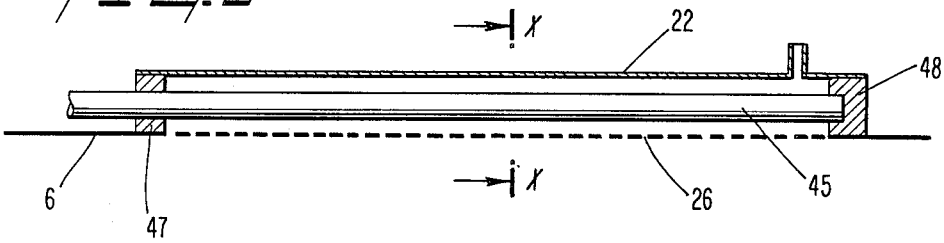
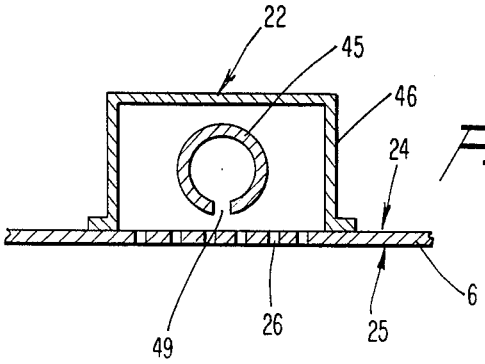
Fig. 10

Fig. 11
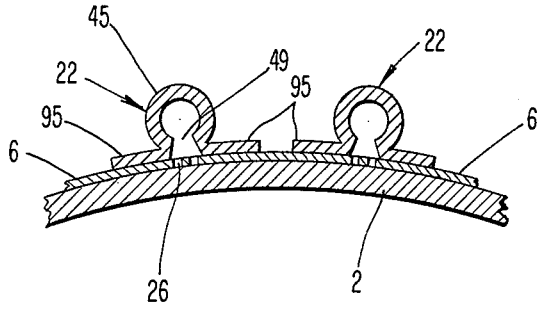
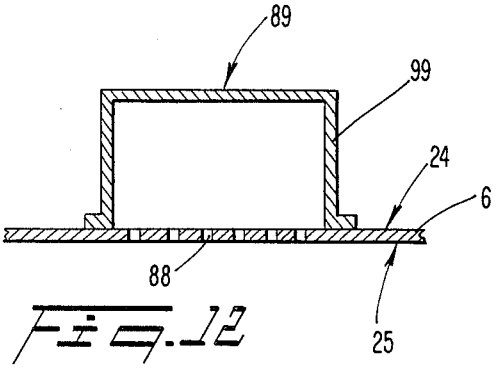
Fig. 12
Fig. 14
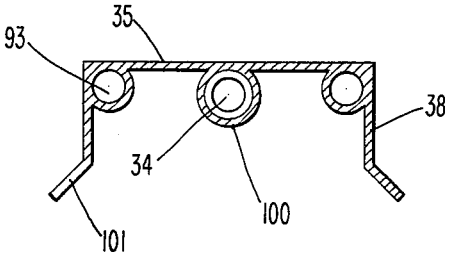
Fig. 13
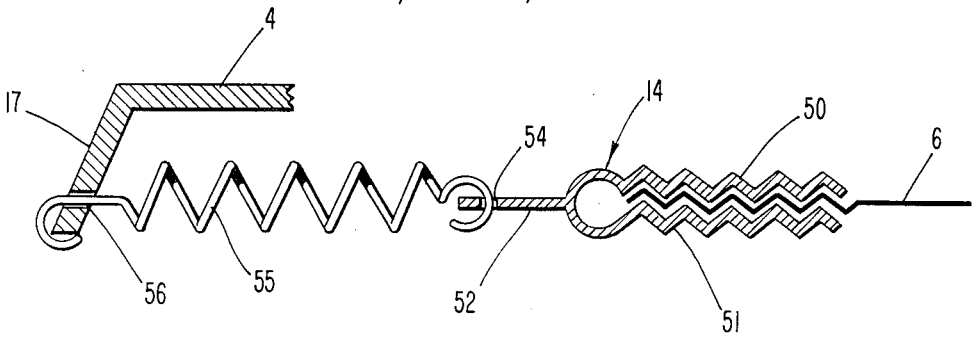

PHOTOCOPY DEVELOPMENT STATION

BACKGROUND OF THE INVENTION

1. Field of the Invention

The present invention relates to an improved development station for an apparatus for the diazotype reproduction of originals, and to a diazotype reproduction apparatus incorporating such improved development station.

For the sake of convenience, the support sheet of paper or polymer film coated with a sensitive diazo layer will herein be referred to as the "copy", while the sheet of transparent or semi-transparent paper or polymer film bearing the graphic intelligence to be reproduced will be designated the "original".

2. Description of the Prior Art

Apparatus for the diazotype reproduction of originals typically comprises at least one exposure station, in which the copy is exposed to light through the original in order to form a latent image on the copy, and a development station, in which the copy bearing the latent image is contacted with a material for the development of the latent image, such that the latent image will become visible.

The material for the development of the latent image may be liquid or gaseous. In the present text, reference will more specifically be made to a development station wherein the material used to develop the latent image is a gas comprised of ammoniacal vapors.

The development station is provided with means for advancing the copy into a zone of the development station where the copy will be exposed to the action of the ammoniacal vapors.

The drive means and the means for contacting the copy with the ammoniacal vapors typically comprise driven endless belts, which define a plane or cylindrical surface in registration with the perforated surface of an elongate vessel, the length of which is at least equal to the useful width of the development station, the vessel being charged with the ammoniacal vapors.

On feeding between the belts and the perforated surface of the vessel, the copy bearing the latent image is thus driven by the belts and the latent image is developed by the ammoniacal vapors which pass through the perforations in the vessel.

The developed copy can then similarly advance between the belts and another vessel which has a perforated wall and which is maintained under negative pressure in order to eliminate the excess ammoniacal vapors present on the copy.

This type of construction of a development station generally gives satisfactory results, but it nonetheless has disadvantages.

Numerous problems in respect of gas-tightness indeed arise, insofar as said development vessels are concerned, and these development stations are often foul smelling. In addition, as the volume of the vessel through which the ammoniacal vapors pass is relatively great, and as the speed of the vapors contacting the sensitive coating must be high, substantial volumes of ammoniacal vapors are used, thereby increasing the size of the development station on the one hand and, on the other, also increasing the size of the ammoniacal vapor supply means, while a large volume of unused vapors has to be treated with an acid solution, which also increases the size of the neutralization equipment.

SUMMARY OF THE INVENTION

Accordingly, a major object of the present invention is the provision of an improved development station having small dimensions, in which the problems of gas-tightness are diminished.

This invention also provides an odorless development station which requires but small volumes of material to develop the latent image.

Briefly, the present invention features a development station for apparatus for the diazotype reproduction of originals, which development station comprises, in particular, means for driving the copy and means for developing the latent image borne by the copy, and is characterized in that the copy drive means comprise a rotary cylinder cooperating with a fixed web stretched between two fastening zones, said web surrounding and engaging a portion of the surface of said cylinder, and the copy advancing by the effect of the rotation between the cylinder and the web. The means for developing the latent image borne by the copy are means for bringing the copy into contact with the material for the development of the latent image. Said means include at least one pathway situated on that face surface of the web which is not in contact with the copy, while the interior of the pathway is in communication with that face surface of the web which is in contact with the copy by way of openings extending through said web, said pathway being provided with inlet and outlet means for said developing material.

In one embodiment of the invention, the development station is provided with a pathway and the openings extending through the web are grouped into a band situated substantially along a generatrix of the cylinder, the band being such that its length is substantially equal to the useful width of the development station and its width is between 1 and 20% of the length of the arc over which the cylinder is enveloped by the web.

The width of the band is preferably from 2 to 15% of the length of the arc over which the cylinder is enveloped by the web.

In another embodiment of the invention, the development station has a plurality of pathways and is such that the openings extending through the web are grouped into bands situated substantially along the generatrices of the cylinder, one band corresponding to each pathway, while the bands are such that their lengths are substantially equal to the useful width of the development station and the sum of their widths is from 1 to 20% of the length of the arc over which the cylinder is enveloped by the web.

The sum of the widths of the bands is preferably from 2 to 15% of the arc over which the cylinder is enveloped by the web.

The dimensions of the pathway are of course substantially equal to the dimensions of the band.

The pathway may be charged with a material for developing the latent image which is either liquid or gaseous. For a development station using a liquid developer, the openings establishing communication between the interior of the pathway and that face surface of the web which is in contact with the copy will have dimensions such that that face surface of the web which is in contact with the copy will be wet by the liquid without the latter spilling down.

The pathway may be formed directly in the web, that is to say, it may be integral with the web; it may, for example, be formed by extrusion if the web is of a plastic material. It may also be formed with the aid of a preferably preformed band fastened to the periphery of the apertured band of the web, for example, welding or adhesive bonding, and provided with inlet and outlet means for the material for developing the latent image.

The pathway may also be formed by an open sectional member fastened to the periphery of the apertured band of the web by adhesive bonding or welding, and provided at its ends with plugs, through which communicate the developer inlet and outlet means.

In another embodiment of the invention, the pathway may be provided in its interior with a developer dispenser. A dispenser of this type may comprise a hollow cylinder open at one end and closed at the other, and provided with a slot substantially along a generatrix close to the apertured band of the web. The developer material is supplied at the open end of the dispenser, and unused material, collected by the pathway, transfers out of the latter through an opening provided for that purpose.

In another form of construction of a development station according to the invention, in which the pathway includes a dispenser, the dispenser occupies substantially all of the interior of the pathway, this dispenser being in the form of a hollow cylinder provided with at least one opening substantially on a generatrix and being maintained in place by a band fastened to the web to form the pathway, in such a manner that the opening is situated as close as possible to the apertured band of the web, said dispenser being connected at its ends to inlet and outlet connections for the material for developing the latent image.

In this embodiment, the band may be made from a fabric, for example, a glass fabric, impregnated with a resin such as polytetrafluoroethylene, but may also be made of an elastomer extruded into a section of suitable shape for surrounding the dispenser.

The band may be secured to the web by adhesive bonding.

In another embodiment of the invention, the development station is so arranged that the pathway comprises a dispenser in the form of a hollow cylinder provided with at least one opening lying substantially on a generatrix, said dispenser being provided with two fins for fastening it to the web, these fins being situated one on each side of the opening in such a manner that the opening will be situated as close as possible to the apertured band of the web, and said dispenser being connected to inlet and outlet connections for the material for developing the latent image.

In another embodiment, the pathway may have a zone forming a gutter situated at a height below the apertured band of the web.

A pathway according to this embodiment makes it possible to circulate a liquid material in the gutter, this liquid material generating vapors which, on passing through the openings in the web, contact the latent image.

The material for developing the latent image is advantageously introduced into the pathway only when a copy is advanced to the development station. Thus, preferably, the development station is provided with means which, in response to advancement of a copy, initiate and terminate the feeding of developer into the pathway.

These means may include a contactor which, when activated by the front edge of the copy, initiates the feeding of the developer into the pathway and, when it is deactivated by the passing of the rear edge of the copy, terminates, with a delay, the feeding of the developer into the pathway.

The development station is, in addition, advantageously provided with means for degasifying the copy downstream of the latent image development means, referring to the direction of movement of the copy.

The copy degasification means may comprise a zone of the web provided with through holes and of suction means situated near the apertured zone and acting on that face surface of the web which is not in contact with the copy.

A development station using a liquid latent image developer material will preferably be provided, between the pathway and the apertured zone of the web, with means for drying the copy, typically heating means.

The suction means may be a vessel, one wall of which, provided with apertures, is situated near the apertured zone of the web, the suction being, for example produced by means of a fan.

In another embodiment, the degasification means include a zone of the web provided with through holes and a vessel maintained under negative pressure, the open zone of this vessel being situated close to the apertured zone of the web, while the walls of the vessel which bound the open zone extend on each side of the zone provided with apertures substantially as far as that face surface of the web which is not in contact with the copy.

In another form of construction of the development station of the invention, the suction means comprise a hollow cylinder closed at at least one end and provided with an opening for producing a negative pressure within the cylinder, the cylinder wall being provided with at least one opening disposed substantially on a generatrix of the cylinder close to the apertured zone of the web.

The opening for producing a negative pressure inside the cylinder may be the opening situated at an end of the cylinder which is connected to the suction side of a fan. The opening situated substantially on a generatrix of the cylinder may be a slot extending through the wall of the cylinder.

The cylinder may be fabricated from any material, particularly a plastic material.

The development station according to the invention may be provided, downstream of the means for contacting the copy with the latent image developer material, referring to the direction of movement of the copy, with means for recovering unused developer.

The unused developer recovery means may comprise a zone of the blanket which is provided with through holes and of collection means situated near said zone, the collection means being connected to suction means acting on that face surface of the web which is not in contact with the copy, said suction means directing the developer towards the inlet of the pathway for the material for developing the latent image.

In one embodiment, the collection means is a collector in the form of a band fastened to the periphery of the apertured zone of the web.

In another embodiment, the collection means is a collector formed by a sectional member having an open section, closed at at least one end, and fastened to the periphery of the apertured zone of the web.

In yet another embodiment, the collection means is a collector in the form of a hollow cylinder closed at at least one end, the wall of the cylinder being provided with at least one opening situated substantially on a generatrix of the cylinder close to the apertured zone of the web.

In a variant, the collector may be held in place by a band fastened to the web in such a manner that the opening is situated as close as possible to the apertured zone of the web.

In another variant, the collector is provided with two fins situated, one on each side of the opening, and fastened to the web in such a manner that the opening is situated as close as possible to the apertured zone of the web.

As will be seen, the various forms of construction of the collection means are similar to those described for the pathway for the latent image developer material.

A development station according to the present invention, which is provided with unused developer recovery means, may obviously be provided with degasification means downstream of the recovery means, referring to the direction of the movement of the copy.

For improvement in the effectiveness of the development, it is advantageous for the material used for developing the latent image to be hot, and the development station according to the invention is preferably additionally provided with means for heating the developer.

The developer may be heated in any suitable device before being fed into the pathway, but it may also be heated by heating means, such as an electric resistor, placed in the pathway.

The development station may optionally be provided with means for preheating the developer.

In one embodiment, the preheating means comprise a circulation tube connected at one end to the inlet of the pathway and at the other end to the developer source, this tube being situated close to the pathway.

The region close to the pathway is generally a hot region of the development station, because the latent image developer material is fed into the pathway after having been heated and/or because heating means are provided for the purpose of directly heating the developer in the pathway.

In order to further improve the effectiveness of the development of the latent image, it is advantageous for the latter to be heated. The development station of the invention may thus additionally be provided with copy preheating means situated upstream of the pathway.

In one embodiment, the copy preheating means comprises an electric resistor situated near that face surface of the web which is not in contact with the copy, upstream of the pathway.

In another form of construction of the development station of the invention, the developer heating means and the copy preheating means include an electric resistor associated with a reflector, both situated near the pathway and disposed in such a manner that the reflector directs the thermal radiation onto the pathway and a zone of that face surface of the web which is not in contact with the copy, said zone being adjacent to the pathway and situated upstream of the latter.

In one embodiment, the development station according to the invention may be constructed such that the electric resistor is housed in the reflector and that the developer preheating means includes ducts provided in the reflector.

A reflector of this type may be formed by a sectional member, for example, of aluminum, the housing for the electric resistor and the ducts being directly formed in the production of the sectional member.

In order to also improve the effectiveness of the development of the latent image, it is advantageous for the development station to be provided with means for dampening the copy, situated upstream of the pathway.

The copy can be dampened by contacting it with a humid gas, such as humid air. The copy dampening means can thus include a pathway situated on that face surface of the web which is not in contact with the copy, the interior space of the pathway being in communication with that face surface of the web which is in contact with the copy by way of openings extending through the web, and said pathway being provided with humid gas inlet and outlet means.

The various forms of construction of this pathway are similar to those described for the pathway for the latent image developer material and for the collection means. They will not be specifically described.

In a development station provided with a pathway for the circulation of humid gas, the copy preheating means may comprise an electric resistor situated in the humid gas circulation pathway.

To ensure that the copy is correctly driven by the cylinder, it is necessary for the web to match as closely as possible the surface of the cylinder, and for this purpose the web is of slight thickness in order to have sufficient flexibility to enable it to match or assume the shape of any defects in the regularity of the cylinder.

To enable the copy to slide on the surface of the web, it is necessary for that face surface of the web which is in contact with the copy to be relatively smooth.

The web may be a sheet of various materials, such as a sheet of metal or plastic material. The material selected must of course have good resistance to the latent image developer material.

A web made of polytetrafluoroethylene is particularly suitable. Polytetrafluoroethylene in fact makes it possible to obtain a relatively flexible web which is corrosion-resistant and has a satisfactory surface state, while, in addition, the low coefficient of friction of polytetrafluoroethylene assists the sliding of the copy in contact with the web.

According to this invention, the web is provided, at both its ends, with fastening zones in the form of two sectional members provided with fastening means at each end of the web, and with means for fixing the sectional member to a fastening means provided for that purpose in the structure of the development station.

In order that the web may match as closely as possible the surface of the cylinder and assume the configuration, as accurately as possible, of any defects in regularity of the latter, it is preferable for the development station to be provided with means for the automatic adjustment of the tension of the web.

These adjustment means make it possible to obtain a substantially constant contact pressure of the web on the cylinder, whatever the cylindricity of the latter, and whether or not a copy is being driven between the web and the cylinder. A constant web tension makes it possible for the copy to be driven at a regular speed and prevents any operational overload on the cylinder drive motor.

In one embodiment, the means for the automatic adjustment of the web tension may advantageously comprise at least one flexible blade acting on the face surface of the web and situated between the fastening sectional member and the first line of contact of the web and the cylinder. The development station preferably has two flexible blade type means for the automatic adjustment of the web tension.

In another embodiment, the automatic web tension adjustment means may be elastic means situated between the sectional member and the fastening means provided in the structure of the development station. The development station is preferably provided with automatic web tension adjustment means comprising elastic means close to each sectional member.

In yet another embodiment, the automatic web tension adjustment means may comprise elastic means, such as an elastic blade, for example of rubber, interposed between the fastening sectional member and the end of the web. An elastic blade is preferably provided at each end of the web.

The development station of the invention is adopted for an apparatus for the diazotype reproduction of originals.

It is intended more particularly for the construction of an apparatus for the diazotype reproduction of originals which is of modular design, such an apparatus composed of at least two modules: a first module containing an exposure station, and a second module containing a development station according to the present invention.

A reproduction apparatus of this type may also contain a copy paper feed module.

The invention will be better understood from the description of the accompanying drawings, which illustrate schematically, and without any definite scale, certain embodiments of the invention.

BRIEF DESCRIPTION OF THE DRAWINGS

FIG. 2 is a detail view, in cross-section through an axial plane, of one form of construction of the end of the cylinder.

FIG. 3 is a plan view illustrating one form of construction of the web.

FIG. 4 is a cross-sectional view, through a plane at right angles to the axis of the cylinder, of the web of the type illustrated in FIG. 3.

FIG. 6 is a detail view of the pathways and dispensers in the development station shown in FIG. 5.

FIG. 7 is a plan view illustrating another form of construction of the web.

FIG. 8 is a cross-sectional view illustrating one form of construction of the pathway, through a plane at right angles to the axis of the cylinder.

FIG. 9 is a cross-sectional view of another form of construction of the pathway, through a plane parallel to the axis of the cylinder.

FIG. 10 is a cross-sectional view, through the plane X—X, of a pathway according to the form of construction shown in FIG. 9.

FIG. 11 is a cross-sectional view illustrating yet another form of construction of the pathway, through a plane at right angles to the axis of the cylinder.

FIG. 12 is a cross-sectional view, through a plane at right angles to the axis of the cylinder, of one form of construction of the developer recovery means according to the invention.

FIG. 13 is a cross-sectional view of one form of construction of the web fastening zone according to the invention.

FIG. 14 is a cross-sectional view of one form of construction of the reflector according to the invention.

DETAILED DESCRIPTION OF THE PREFERRED EMBODIMENTS OF THE INVENTION

Figure 1:
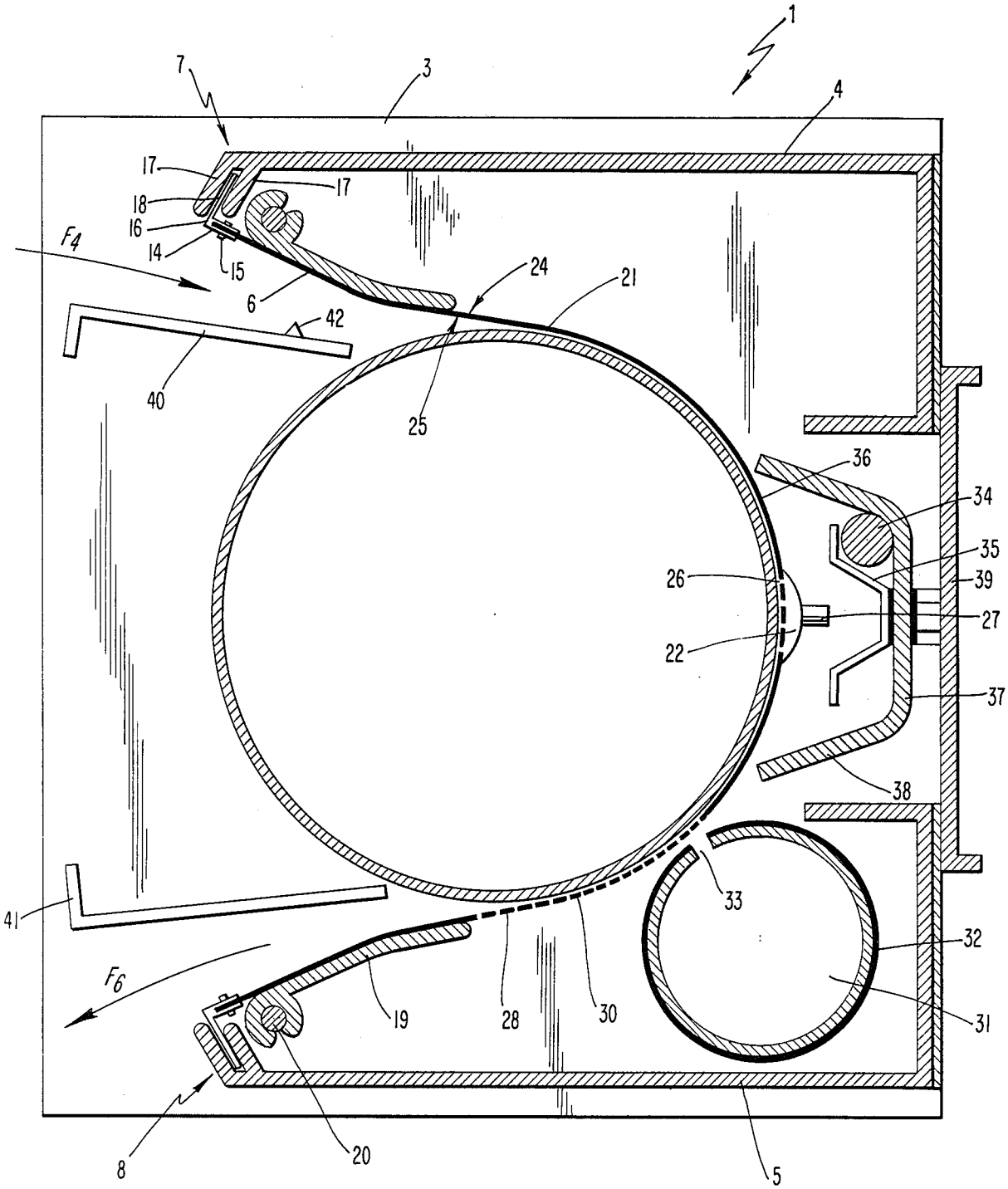
FIG. 1 is a cross-sectional view, through a plane at right angles to the axis of the cylinder, of one form of construction of a development station according to the invention.

The invention will now be described with more specific reference to the utilization of a gaseous material for developing the latent image. The use of a liquid material for developing the latent image is obviously also within the scope of the invention.

The development station 1, one form of construction of which is shown in cross-section through a plane at right angles to the axis of the cylinder 2, comprises a housing 3 fixed to a support frame composed of two end plates (not shown) connected by two braces 4 and 5, for example, aluminum profiles. Inside the housing 3, the development station is provided with copy drive means and development means.

The copy drive means include a cylinder 2 adopted for rotational movement and cooperating with a fixed web 6 stretched between two fastening zones 7 and 8.

The cylinder 2 is supported at its ends by the end plates 9 [FIG. 2] provided with cylindrical bearing surfaces 10. The cylinder 2 is provided at its ends with tips 11. At one of the ends of the cylinder 2, as illustrated in FIG. 2, the tip 11 is fastened to the cylinder 2, for example by force fit or adhesively bonded thereto, and provided with means for the rotational driving of the cylinder 2; these means may be a pinion 12. In order to facilitate the rotation of the cylinder 2 relative to the cylindrical bearing surface 10 of the end plate 9, a ring 13, for example of polytetrafluoroethylene, may be placed between the tip 11 and the cylindrical bearing surface 10. The ring 13 is free to turn in relation to the tip 11, on the one hand, and in relation to the cylindrical bearing surface 10 of the end plate, on the other hand.

The cylinder 2 may be made of any material, provided that the latter has mechanical properties such that the cylinder 2 is practically undeformable. The surface state of the cylinder 2 is advantageously such that it has sufficient adhesion to drive the copy, for which purpose the surface of the cylinder may be provided with a covering. For the construction of a development station according to the invention, a cylinder of aluminum covered with natural, artificial, or synthetic rubber is particularly suitable.

The fixed web 6 cooperating with the cylinder 2 is formed in the present embodiment of a sheet of plastic material, which in the present case is polytetrafluoroethylene. The web is stretched between two fastening zones 7 and 8 [see detail] formed by two sectional members 14 provided with fastening means 15, such as rivets, at each end of the web 6. The sectional member 14 is also provided with fastening means 16, formed by L-shaped folding of the sectional member 14, for fixing to an attachment means provided in the structure of the development station. In the embodiment illustrated, these attachment means are defined by a groove 18 situated between two fins 17 carried by the braces 4 and 5, over their entire length.

The web 6 surrounds a portion of the surface of the cylinder 2 to permit the engagement of a copy between the web 6 and the cylinder 2.

To enable the web 6 to conform as closely as possible to the defects of regularity of the cylinder 2, the development station is provided with means for the automatic adjustment of the tension of the web 6. These means comprise a flexible blade 19, for example of rubber, carried by a rod 20 fixed at its ends to the end plates, the flexible blade 19 being biased against that face surface 24 of the web 6 which is not in contact with the copy, between the fastening sectional member 14 and the first line 21 of contact of the web 6 with the cylinder 2.

In the embodiment illustrated in FIG. 1, the development station is provided with two flexible blade type adjustment means 19.

Now that the copy drive means have been described, a description will now be given of the means for developing the latent image borne by the copy, that is to say, means for contacting the copy with a latent image developer material.

In the development station according to the invention, the means for contacting the copy with the latent image developer material comprises a pathway 22 situated on that face surface 24 of the web 6 which is not in contact with the copy, the interior space of the pathway 22 communicating with that face surface 25 of the web which is in contact with the copy by way of openings 26 extending through the web 6. The pathway 22 is of course provided with inlet and outlet connections 27 for the material for the development of the latent image borne by the copy.

The openings 26 extending through the web 6 are grouped together in a band placed on a generatrix of the cylinder 2. The band provided with openings 26 is such that its length is equal to the useful width of the development station, and its width is from 1 to 20%, preferably from 2 to 15%, of the length of the arc over which the cylinder 2 is surrounded by the web 6. This area of contact between the web 6 and the cylinder 2 is defined by the arc between the lines 21 and 28.

In the development station of the invention, a point on the copy is thus in contact with the developer material only during the time that it requires to cross over the width of the band provided with openings 26.

As illustrated in FIGS. 3 and 4, the pathway 22 is composed of a preformed band 29 fastened, for example, by adhesive bonding, to the periphery of the band provided with openings 26 on the web.

The band 29 may be made of a textile material, for example, of a glass fabric, coated with a resin, or it may be a sheet, for example, of polytetrafluoroethylene.

The development station according to the invention is also provided with copy degasification means in the form of a zone 30 of the web 6 and situated downstream of the pathway 22, referring to the direction of movement of the copy, and in the form of suction means 31 situated near the apertured zone 30 of the web 6, and acting on that face surface 24 of the web 6 which is not in contact with the copy.

In the embodiment illustrated, the suction means 31 are in the form of a tube 32 closed at one end, its other end being connected to the suction side of a fan. The wall of the tube 32 is provided with a through slot 33 situated substantially on a generatrix of the tube 32 close to the apertured zone 30 of the web 6. During the operation of the development station, the residual gas on the copy is drawn into the interior of the tube 32 through the slot 33. The slot 33 may of course be replaced by a plurality of holes.

Suction means of this type make it possible to ensure effective degasification of the copy.

In the embodiment of the invention which is illustrated in FIG. 1, the developer heating means and the copy preheating means are in the form of an electric resistor 34 associated with a reflector 35, said resistor and reflector being situated close to the pathway 22 and disposed in such a manner that the reflector 35 directs the thermal radiation onto the pathway 22 and a zone 36 of the face surface 24 of the web 6, which zone is adjacent to the pathway 22 and situated upstream of the latter. The resistor 34 and the reflector 35 are placed inside a screen 37 provided with fins 38 extending to the proximity of the web 6, said screen 37 serving to prevent the heating of the other parts of the development station.

The resistor 34, the reflector 35, and the screen 37 obviously extend parallel to a generatrix of the cylinder 2 over the entire useful width of the development station.

The resistor 34, the reflector 35, and the screen 37 are fixed together by appropriate means and are then secured to a closure panel 39 of the development station, the closure panel 39 being for example, screwed to the braces 4 and 5 of the development station.

It is thus sufficient to remove the closure panel 39 to gain access to the electric resistor 34, on the one hand, and to the pathway 22 and the connections 27 on the other.

Guides 40 and 41, formed, for example, by folded metal sheets, enable the copy to be guided respectively to the inlet and the outlet of the development station.

The guide 40 preferably has a contact 42 which, when activated by the front edge of the copy, initiates the feeding of developer into the pathway 22. When the contact 42 is deactivated after the rear edge of the copy has passed, it terminates, after appropriate delay, the feeding of developer into the pathway 22.

In the pathway 22, the developer thus circulates essentially only during the time required for developing the latent image.

The operation of the development station according to the invention will now be briefly described.

A copy bearing a latent image is introduced and guided by the guide 40 between the web 6 and the cylinder 2, in the direction of the arrow $F_4$. When the front edge of the copy passes over the contact 42, the feeding of the developer into the pathway 22 is initiated. By rotation of the cylinder 2, which cooperates with the fixed web 6, the copy is driven between the web 6 and the cylinder 2, being preheated during its travel in contact with the zone 36 of the web 6. The copy bearing the latent image then advances to the band provided with apertures 26 on the web 6, and is then contacted with the developer fed into the pathway 22 and passing through openings 26 in the web 6, whereupon the latent image is developed and becomes visible.

The copy continues its movement between the web 6 and the cylinder 2; when it traverses the apertured zone 30, the residual gases on the copy are withdrawn into the tube 32 through the slot 33, and directed to a neutralization station. As the rear edge of the copy passes over the contact 42, the latter is released and the feeding of developer into the pathway 22 is terminated. This is done after a certain delay in order that the entire copy will have passed in contadt with the band provided with apertures 26 on the web 6.

The copy, ready for use, then exits the development station in the direction of the arrow $F_6$.

Figure 5:
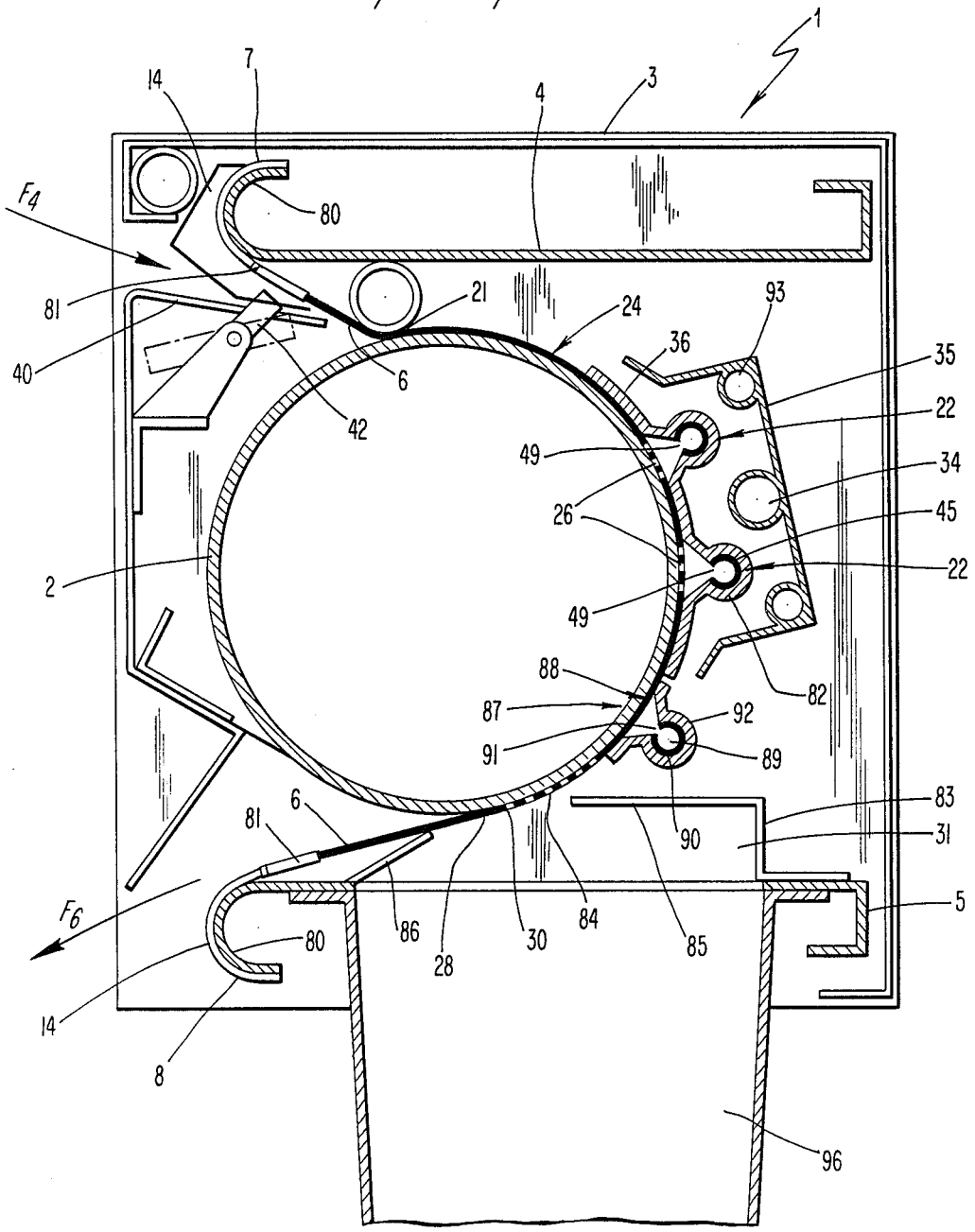
FIG. 5 is a cross-sectional view, through a plane at right angles to the axis of the cylinder, of another form of construction of a development station according to the present invention.

In the embodiment illustrated in FIG. 5, in section through a plane at right angles to the cylinder 2, the development station 1 comprises a housing 3 fixed to a support frame consisting of two end plates (not shown) connected by two braces 4 and 5, for example, aluminum profiles. Inside the housing 3, the development station is provided with copy drive means and development means.

As in the embodiment illustrated in FIG. 1, the copy drive means comprises a cylinder 2 adopted for rotational movement and cooperating with a fixed web 6 stretched between two attachment zones 7 and 8.

The fixed web 6 cooperating with the cylinder 2 is stretched between two attachment zones 7 and 8 formed by two curved sectional members 14 which cooperate with corresponding curved zones 80 provided on the braces 4 and 5.

To enable the web 6 to conform as closely as possible to any defects in regularity of the cylinder 2, the development station is provided with means for the automatic adjustment of the tension of the web 6. These means include an elastic blade 81, for example, of rubber, inserted between the sectional member 14 and the end of the web 6. One elastic blade 81 is preferably provided at each end of the web 6. The elastic blade 81 may be fixed, on the one hand, to the web 6 and, on the other, to the sectional member 14, for example, by means of rivets.

A description will now be given below of the means for developing the latent image borne by the copy, which are means for contacting the copy into contact with a latent image developer material.

In the development station according to this embodiment, the means for contacting the copy with the latent image developer material include two pathways 22 situated on that face surface 24 of the web which is not in contact with the copy, and the interior space of the pathways 22 is in communication with that face surface 25 of the web 6 which is in contact with the copy by way of apertures 26 extending through the web 6. Each pathway 22 is of course provided with inlet and outlet connections for the material for developing the latent image borne by the copy.

The apertures 26 extending through the web 6 are grouped together in a band situated on a generatrix of the cylinder 2, one band of apertures 26 obviously corresponding to each pathway 22.

The bands provided with apertures 26 are such that their length is equal to the useful width of the development station and that the sum of their widths ranges from 1 to 20% and preferably from 2 to 15% of the length of the arc over which the cylinder 2 is contacted by the web 6. This area of contact between the web 6 and the cylinder 2 is defined by the arc between the lines 21 and 28.

In the development station, a point on the copy is thus in contact with the developer material only during the time required for its travel over the widths of the bands provided with apertures 26.

In this form of construction of the development station of the present invention, as illustrated in FIG. 5, a dispenser 45 is placed in the pathway 22. The dispenser 45 occupies substantially the entire interior space of the pathway 22, and is in the form of a hollow cylinder provided with a slot-shaped aperture 49 situated substantially on a generatrix. The slot may of course be replaced by a plurality of apertures, for example, a plurality of small holes, and the use of the expression "aperture 49" in the present text is a generalization.

The dispenser 45 is maintained in place by a band 82 of textile material, for example, of glass fabric, coated with a resin and fastened to the web 6, for example, by adhesive bonding, to form the pathway 22.

In the embodiment illustrated in FIGS. 5 and 6, the same band 82 of textile material forms the two pathways 22 and maintains the two dispensers 45 in place in such a manner that their apertures 49 are situated as close as possible to the corresponding bands provided with apertures 26 in the web 6. Each dispenser 45 is connected at its ends to inlet and outlet connections for the latent image developer material.

The development station also contains copy degasification means 96 comprising a zone 30 of the web 6 provided with through apertures and situated downstream of the pathways 22, referring to the direction of movement of the copy, and suction means 31 situated near the apertured zone 30 of the web 6 and acting on that face surface 24 of the web 6 which is not in contact with the copy.

In the present embodiment, the suction means include a vessel 83 maintained under negative pressure by connection to the suction side of a fan, the wall of the vessel having an open zone 84 situated near the apertured zone of the web 6. The walls 85 and 86 of the vessel which bound the open zone 84 extend on each side of the apertured zone 30 substantially as far as that face surface 24 of the web 6 which is not in contact with the copy.

The development station shown in FIG. 5 contains, downstream of the means for contacting the copy with the latent image developer material, that is to say, the pathways 22, unused developer recovery means 87. The recovery means 87 are of course situated upstream of the degasification means 96, when the development station is provided with such means.

The unused developer recovery means 87 are in the form of a zone 88 of the web 6 which is provided with through apertures, and of collection means 89 situated near the zone 88 and connected to suction means acting on that face surface 24 of the web which is not in contact with the copy, the suction means directing the recovered developer to the inlet of the pathways 22.

In the embodiment illustrated in FIG. 5, the collection means 89 have a structure similar to that of the means for contacting the copy with the latent image developer material. The collection means 89 include a collector 90 in the form of a hollow cylinder closed at at least one end and provided with an aperture intended to produce a negative pressure inside the cylinder. The wall of the collector 90 is provided with at least one aperture 91, such as a slot or a plurality of holes, situated substantially on a generatrix of the cylinder close to the apertured zone of the web 6. The collector 90 may be maintained in place, like the dispenser 45, by means of a band 92 fastened on the face surface 24 of the web 6, for example, by adhesive bonding.

The development station may of course by provided with a plurality of recovery means 87.

A development station of the type illustrated may have its dispensers 45 and collector 90 secured by the same band, that is to say, the band 82 and the band 92 may comprise a single piece of textile material.

The development station according to the present embodiment is provided with means for the preheating of the material for developing the latent image before said developer is fed into the pathway 22. In the embodiment illustrated in FIG. 5, the preheating means include a tube 93 for circulating the developer via a flow and return path connected at one end to the pathways 22 and at the other end to the developer source; the tube 93 is situated close to the pathways 22. This tube 93 is thus situated in the hottest zone of the development station, that is to say, in the zone onto which the reflector 35 directs the thermal radiation due to the electric resistor 34 heating the developer circulating in the pathway 22.

The operation of the development station according to this embodiment will now be briefly described.

A copy bearing a latent image, guided by the guide 40, is introduced between the web 6 and the cylinder 2 in the direction of the arrow $F_4$. As the front edge of the copy passes over the contact 42, the feeding of developer into the pathways 22 is initiated, the developer being preheated by passage in the tube 93. Through the action of rotation of the cylinder 2, which cooperates with the fixed web 6, the copy is driven between the web 6 and the cylinder 2, being preheated as it contacts that zone 36 of the web 6 onto which the reflector 35 directs the thermal radiation due to the electric resistor 34. The copy bearing the latent image then reaches the bands provided with apertures 26 on the web 6, whereupon it is contacted with the developer fed into the pathways 22 and passing through the apertures 26 in the web 6, and the latent image becomes visible.

The copy continues its movement between the web 6 and the cylinder 2, and as it passes in contact with the apertured zone 88, the latent image developer material which has not been used is drawn through the apertures to the recovery means 87 and then recycled to the inlet of the pathways 22.

The copy then continues its movement between the web 6 and the cylinder 2, and as it passes in contact with the zone 30 provided with apertures, the residual gases on the copy are drawn into the vessel 83 and directed towards a neutralization station. As the rear edge of the copy passes over the contact 42, the latter is released and the feeding of developer into the pathways 22 is terminated. Termination of the feeding occurs after a certain delay in order to ensure that the entire copy will have been in contact with the bands provided with apertures 26 on the web 6.

The copy, ready for use, then exits thd development station in the direction of the arrow $F_6$.

FIG. 7 shows another form of construction of the web 6, in which the passage is in the form of a sectional member 43 which has an open section and is fastened by welding to the web 6. The ends of the sectional member 43 are closed by plugs, through which pass the developer inlet and outlet connections 27.

FIG. 8 shows yet another form of construction of the passage. This passage is also in the form of a sectional member 43 which has an open section and which has a shape such that the passage has a zone forming a gutter 76 situated at a height below the apertured band of the web. At one end it has a connection for supplying liquid into the gutter, and at the other end a connection for the discharge of gas in the top part.

The liquid 77 circulating in the gutter 76 is heated by the heating means of the type shown in FIG. 1, and generates vapors which, on passing through the apertures 26 in the web 6 contact the latent image, and the latent image becomes visible.

Another form of construction of the pathway 22 is shown in FIGS. 9 and 10. In this embodiment, the pathway 22 contains in its interior a latent image developer material dispenser 45. The pathway is formed by a sectional member 46 closed at its ends by two plugs 47 and 48 fastened, for example, by adhesive bonding, to the periphery of the band provided with apertures 26 on the web 6. The dispenser 45 includes a hollow cylinder maintained in place by the plugs 47 and 48; the cylinder extending through the plug 47 is engaged in the plug 48, the latter closing that end of the cylinder. The cylinder has an aperture in the form of a slot 49 situated substantially on a generatrix of the cylinder close to the band provided with apertures 26 on the web 6. The latent image developer material is supplied to the dispenser 45 through that end of the latter which is situated in the plug 47, and passes out of the dispenser by way of the slot 49, distributed in the form of a sheet, thereupon passing through the web 6 via the apertures 26 to contact the latent image borne by the copy. The slot 49 may of course be replaced by a plurality of holes.

Passages permitting distribution in the form of a sheet are particularly suitable when the latent image developer material is gaseous.

The means for contacting the copy with the latent image developer material, which are shown in FIG. 11, are such that the pathway 22 includes a dispenser 45 in the form of a cylinder provided with at least one aperture 49, such as a slot or a plurality of apertures, situated substantially on a generatrix. The dispenser 45 is provided with two fins 95 situated one on each side of the aperture 49 and intended for fastening the dispenser 45 to the web 6, in such a manner that the aperture 49 is situated as close as possible to the band provided with apertures 26 on the web 6.

Two pathways 22, such as those shown in FIG. 11, can obviously have one common fin 95 disposed between the dispensers 45.

The forms of construction of the pathways 22 described above and illustrated in FIGS. 1, 3, 4, 6, 7, 9, 10 and 11 may of course be used for forming the collector of the collection means for the unused latent image developer material.

Another variant of the collection means 89 is illustrated in FIG. 12. The collection means 89 are here composed of a collector formed by a sectional member 99 which has an open section and is closed at one end, the other end being connected to suction means. The sectional member may be closed at both ends, and is then provided with a connection extending through its wall. The sectional member 99 is fastened to the periphery of the apertured zone 88 of the web 6, on that face surface 24 of the latter which is not in contact with the copy.

FIG. 13 shows, in section, another form of construction of the attachment zone 7 of the web 6 and of the means for the automatic adjustment of the tension of the web 6.

The attachment zone is formed by a sectional member 14 having three flanges 50, 51 and 52, the flanges 50 and 51 being substantially parallel. The web 6 is engaged between the parallel flanges 50 and 51 and the entire arrangement is deformed in zigzag fashion by crushing between profiled rollers. The flange 52 of the sectional member 14 is provided with three holes 54 intended for the attachment of one end of a spring 55, the other end of the spring being attached to the flange 17 of the brace 4, which is provided with holes 56. Thus, in the present embodiment, a plurality of springs 55 distributed along the sectional member 14 constitutes elastic means for the automatic adjustment of the tension of the web 6.

In the embodiment illustrated in FIG. 14, the reflector 35 is in the form of a metal section, for example, of aluminum, in which a socket 100, which will receive the heating resistor 34, and the two ducts 93 will be formed directly during manufacture, said two ducts being intended for the circulation of the latent image developer material before its introduction into the pathway 22, this circulation thus permitting the preheating of the developer. In this embodiment, the reflector 35 has two flanges 101 extending to the proximity of the web 6 in order to prevent the heating of the other parts of the development station.

Figure 15:
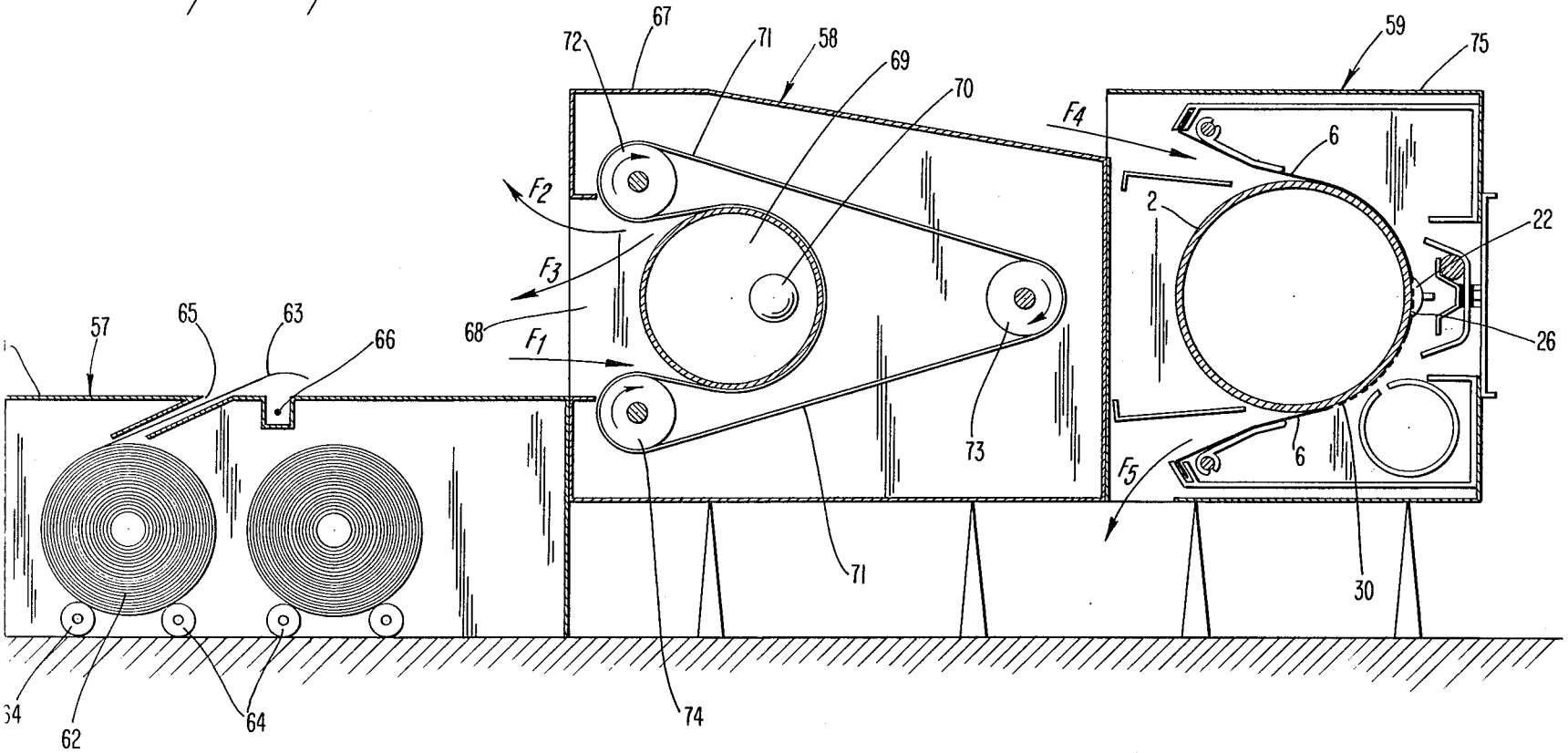
FIG. 15 is a schematic view of an apparatus for the diazotype reproduction of originals according to the invention, including a cross-section of a development station according to the invention, through a plane at right angles to the axis of the cylinder.

An apparatus for the reproduction of originals which incorporates a development station according to the invention, of the type illustrated in FIG. 1, is shown in FIG. 15. The apparatus is of modular design. It comprises a copy paper feed module 57, a module 58 containing an exposure station, and a module 59 containing a development station according to the present invention.

The copy paper feed module 57 is substantially in the form of a parallelepipedic casing 60 provided with an opening closed by a pivoting lid 61 for positioning one or more rolls 62 of copy paper in the casing 60. The rolls 62 are free to turn about their own axes through the action of the traction of the copy paper 63, and are, for example, placed on a cradle 64 formed by two cylindrical rods parallel to the axis of the roll 62 and provided with means for securing the roll 62 in respect of translatory movement.

The top surface of the casing 61 has a slot 65 to serve as copy paper outlet, and a wire type cutting device 66.

The module 58 containing the exposure station comprises a substantially parallelepipedic casing 67 provided with an opening 68 and confines an exposure station.

The exposure station comprises an exposure cylinder 69, inside of which a lamp 70 is disposed, and means for driving the copy and the original around the exposure cylinder 69. The drive means include an endless belt 71 surrounding three rollers 72, 73 and 74, at least one of which is driven rotationally; the endless belt 71 extends around a portion of the exposure cylinder 69, and the exposure cylinder 69 is positioned such that that portion of the belt 71 which extends around it is diverted into the interior of the prism defined by the axes of the rollers 72, 73 and 74. The rollers 72, 73 and 74 and, optionally, the exposure cylinder 69, are supported at their ends by support plates connected to the frame 58 of the module.

The module 59 containing the development station contains, inside a substantially parallelepipedic casing 75, a development station according to the present invention, similar to that described above and illustrated in FIG. 1.

The operation of a diazotype reproduction apparatus of this type will now be briefly described.

The operator advances the end of the copy paper 63 and places above it the original which is to be reproduced. He engages the superposed original and copy paper, in the direction of the arrow $F_1$, between the endless belt 71 and the exposure cylinder 69. As the copy paper and original advance around the exposure cylinder 69, the latent image is formed on the copy, and the original and copy exit the exposure station close to the roller 72. The operator grips the front edge of the copy, which exits in the direction of the arrow $F_2$, to separate it from the original, which exits the exposure station in the direction of the arrow $F_3$ and is received on the top surface of the casing 60 of the paper feed module. He engages the copy bearing the latent image in the direction of the arrow $F_4$ between the web 6 and the cylinder 2 of the development module 59. As the copy advances around the cylinder 2, the ammoniacal vapors supplied via the pathway 22 and contacted with the copy by way of the apertures 26 in the web 6 develop the latent image, which becomes visible. After travelling along the zone 30 of the web 6, the copy is subjected to degasification and exits the development module in the direction of the arrow $F_5$, ready for use.

The reproduction apparatus according to the invention is shown in FIG. 15, with the module containing the development station situated at the side of the module containing the exposure station, but these two modules can of course be placed one above the other.

The development station of the invention offers numerous advantages.

As will be seen from the description given above, problems of gas-tightness are reduced to a minimum through the design of the development station. The developer in fact flows only through the pathway, and it is easy to achieve gas-tightness of this pathway on the periphery of the apertured band, because the pathway can either be made in one piece with the web, or be formed by adhesive bonding or welding of a band or section on the periphery of the apertured band.

Furthermore, the development station according to the invention provides the advantage of requiring only small volumes of developer. On the one hand, in fact, the volume of the pathway is small, while, on the other hand, the develope is charged into the pathway only during the time required for the travel of the copy through the development station.

Moreover, the development station of the invention is particularly effective in the development of a latent image by ammoniacal vapors. The higher the speed of the gas coming into contact with the diazo coating, in fact, the more effective the development will be. In the development station of the present invention, on the one hand, the gas travel from the pathway to the copy is small, because it is equal to the area of the apertures provided in the band, and, on the other hand, since the volume of the pathway is small, the gas undergoes practically no expansion, with the consequence that the speed of the gas passing through the apertures is high.

A development station according to the invention which uses a gaseous material to develop the latent image also offers the advantage of being small in size.

The use of a small volume of gas makes it possible to considerably reduce the dimensions of the apparatus, on the one hand, and the maintenance that it requires, on the other.

In addition, as the volume of gas used is small, the volume of gas recovered by degasification of the paper is also small, and this makes it possible to reduce the dimensions of the neutralization apparatus, and the latter is saturated only slowly. Also, the frequency with which the station generating the ammoniacal vapors needs to be replenished is low.

Furthermore, a development station of this type is particularly suitable for the construction of a diazo reproduction apparatus of modular design.

While this invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A photocopy development station which comprises means for driving a copy bearing a latent image and means for developing said latent image, said copy drive means comprising a rotary cylinder engaging a tensioned fixed web and said web encircling a portion of the circumferential face surface of said cylinder, whereby a copy can be frictionally rotated therebetween, and said development means comprising at least one pathway arranged on the outside face surface of said web, with the interior of said pathway being in communicating relationship with the inside face surface of said web and adapted to deliver developer material to a copy frictionally passing between said cylinder and said web, said communicating relationship being formed by a plurality of apertures extending through said web and communicating with said pathway, said apertures being grouped into a band situated on a generatrix of the cylinder, said band having essentially the same length as the functional width of the development station, and the width thereof ranging from about 1 to 20 percent of the length of web encircling said cylinder.

2. The photocopy development station as defined by claim 1, said pathway comprising a band secured to said web.

3. The photocopy development station as defined by claim 1, said pathway comprising an elongate sectional member.

4. The photocopy development station as defined by claim 1, said pathway comprising a dispenser for developer material.

5. The photocopy development station as defined by claim 4, said dispenser substantially completely occupying the interior of said pathway and provided with developer outlet means in close proximity to said plurality of apertures.

6. The photocopy development station as defined by claim 2, said pathway comprising a gutter situated at a height below said band secured to the web.

7. The photocopy development station as defined by claim 1, further comprising means for initiating or terminating the action of developer material in response to copy feed.

8. The photocopy development station as defined by claim 1, further comprising means for degasifying developed copy.

9. The photocopy development station as defined by claim 8, said degasifying means comprising a plurality of holes extending through said web and suction means in functional relationship therewith.

10. The photocopy development station as defined by claim 8, further comprising means for recovering unused developer material upstream of degasification.

11. The photocopy development station as defined by claim 10, said recovery means comprising a plurality of holes extending through said web and suction/collection means in functional relationship therewith.

12. The photocopy development station as defined by claim 1, further comprising means for heating the developer material.

13. The photocopy development station as defined by claim 12, said heating means comprising an electric resistor disposed within said pathway.

14. The photocopy development station as defined by claim 12, further comprising developer material preheating means.

15. The photocopy development station as defined by claim 1, further comprising copy dampening means.

16. The photocopy development station as defined by claim 1, further comprising means for the automatic tensioning of said web.

17. The photocopy development station as defined by claim 1, said web comprising polytetrafluoroethylene.

18. Diazotype reprography apparatus comprising the photocopy development station as defined by claim 1.

19. Diazotype reprography apparatus comprising an exposure module, and a module of the photocopy development station as defined by claim 1.

20. The diazotype reprography apparatus as defined by claim 19, further comprising a copy paper feed module.

21. The photocopy development station as defined by claim 1, there being a plurality of said bands spaced apart in the direction of rotation of said cylinder, and a plurality of said pathways communicating with respective ones of said bands.

22. A photocopy development station which comprises means for driving a copy bearing a latent image and means for development said latent image, said copy drive means comprising a rotary cylinder engaging a tensioned fixed web and said web encircling a portion of the circumferential face surface of said cylinder, whereby a copy can be frictionally rotated therebetween, and said developing means comprising at least one pathway on the outside face surface of said web, with the interior of said pathway being in communication relationship with the inside face surface of said web and adapted to deliver developer material to a copy frictionally passing between said cylinder and said web, said communicating relationship being formed by a plurality of apertures extending through said web, said development means comprising a plurality of pathways, each communication relationship formed by a plurality of apertures extending through said web, and the apertures of each such communicating relationship being grouped into separate bands, each situated on a generatrix of the cylinder.

* * * * *